US008178812B2

(12) United States Patent
Martin et al.

(10) Patent No.: US 8,178,812 B2
(45) Date of Patent: May 15, 2012

(54) INSULATION OF A SWITCHGEAR DEVICE OF VACUUM CARTRIDGE TYPE BY INSERT MOULDING

(75) Inventors: Ludovic Martin, Autrans (FR); Christian Mennessier, Eybens (FR); Catherine Herault, Claix (FR); Bruno Chatelet, Lumbin (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 238 days.

(21) Appl. No.: 12/734,804

(22) PCT Filed: Dec. 19, 2008

(86) PCT No.: PCT/FR2008/001788

§ 371 (c)(1), (2), (4) Date: May 25, 2010

(87) PCT Pub. No.: WO2009/106731

PCT Pub. Date: Sep. 3, 2009

(65) Prior Publication Data

US 2010/0246102 A1 Sep. 30, 2010

(30) Foreign Application Priority Data

Dec. 21, 2007 (FR) ..... 07 08970

(51) Int. Cl.
*H01H 33/662* (2006.01)

(52) U.S. Cl. ..... 218/118; 200/293; 218/134; 218/139; 218/155

(58) Field of Classification Search ..... 200/293; 218/118, 121, 134–139, 155
See application file for complete search history.

(56) References Cited

U.S. PATENT DOCUMENTS

| | | | | |
|---|---|---|---|---|
| 5,747,765 | A * | 5/1998 | Bestel et al. | 218/155 |
| 5,864,942 | A | 2/1999 | Luzzi | 29/622 |
| 5,917,167 | A * | 6/1999 | Bestel | 218/138 |
| 6,897,396 | B2 | 5/2005 | Ito et al. | 218/120 |
| 7,285,743 | B2 * | 10/2007 | Martin | 218/138 |
| 7,304,262 | B2 * | 12/2007 | Stoving et al. | 218/120 |
| 2004/0164053 | A1 * | 8/2004 | Stoving et al. | 218/118 |
| 2006/0011589 | A1 * | 1/2006 | Hering et al. | 218/118 |
| 2006/0231529 | A1 * | 10/2006 | Daharsh et al. | 218/136 |
| 2007/0090095 | A1 * | 4/2007 | Yoshida et al. | 218/118 |
| 2007/0145015 | A1 * | 6/2007 | Fink et al. | 218/118 |
| 2007/0235415 | A1 * | 10/2007 | Claus et al. | 218/139 |
| 2007/0278187 | A1 * | 12/2007 | Siebens et al. | 218/118 |
| 2008/0087647 | A1 * | 4/2008 | Volkmar | 218/134 |

FOREIGN PATENT DOCUMENTS

| | | |
|---|---|---|
| EP | 0 294 313 | 12/1988 |
| EP | 0 866 481 | 9/1998 |
| EP | 1 041 593 | 10/2000 |
| EP | 1 571 684 | 9/2005 |
| JP | 2001 338557 | 12/2001 |
| JP | 2002 358861 | 12/2002 |
| WO | WO 86/00464 | 1/1986 |

* cited by examiner

*Primary Examiner* — Michael Friedhofer
(74) *Attorney, Agent, or Firm* — Steptoe & Johnson

(57) ABSTRACT

A vacuum cartridge (1) is manufactured with a dielectric coating (22) made from elastomer directly on the enclosure of the chamber (2) of the cartridge (1). To prevent the elastomer from infiltrating into the chamber (2) of the cartridge and/or its enclosure from breaking, cover-plates (26) performing mechanical protection and dielectric deflection cover the covers ($\mathbf{6}_1$, $\mathbf{6}_2$) of the chamber (2) and their braze (8) with the ceramic tube (4).

19 Claims, 1 Drawing Sheet

INSULATION OF A SWITCHGEAR DEVICE OF VACUUM CARTRIDGE TYPE BY INSERT MOULDING

This application is a national stage entry of International Application No. PCT/FR2008/001788, filed Dec. 19, 2008 designating the U.S., which claims the benefit of French Application No. 07/08970, filed Dec. 21, 2007.

BACKGROUND OF THE INVENTION

The invention deals with switches and switchgear units, in particular vacuum cartridges, operating in particular in high and medium voltage. The invention relates to insulation of such equipment by coating with a suitable material.

The invention relates to insulation of a switchgear device by injecting an elastomer in order to over-mould said switchgear device. To palliate a break in its enclosure, or possible infiltrations of the elastomer into the chamber of the switchgear device, the junction areas of the enclosure are protected by mechanical strengtheners that are also dielectric deflectors.

STATE OF THE ART

A vacuum cartridge is formed by an extinguishing chamber in which a low pressure prevails and in which there are located a pair of contacts able to take a closed position enabling the current to flow and an open position in which the two contacts are separated so as to interrupt the current flow. Usually, one contact is stationary, fixed in secured manner to a base-plate of the enclosure, and the other contact is movable with a bellows that surrounds the latter and enables the inside of the chamber to be mechanically insulated.

The enclosure of a vacuum cartridge chamber comprises an insulating case, sometimes also called cartridge or bottle, made from ceramic or glass, which constitutes a generally tubular first central part. The tube is sealed off at its ends by covers, usually made from metal, also called bowls or caps, to which the contacts are connected.

Vacuum cartridges require a dielectric environment to counteract discharges when they are tripped by opening of the contacts. A free space around the cartridge may be sufficient. However, in particular when the operating voltage is high, one option is to locate the cartridge in a tightly sealed enclosure containing a dielectric fluid, a vacuum or $SF_6$ gas. These solutions generate a notable volume occupation of the cartridge, the latter further being cumbersome to implement.

For reasons of compactness, cost and reliability, solid insulators have been developed to coat vacuum cartridges, with in particular insert moulding with epoxy as for example presented in the document EP 0 866 481. This type of insert moulding is however not optimized, in spite of a malleable or elastic layer being able to be possibly inserted between the coating and the cartridge, on account of the different coefficients of thermal expansion of the ceramic cylinder, of the metal bowls and of the epoxy coating, which can cause cracking, or even breaking, of the insulator.

Some thermosetting elastomers do however combine a very good dielectric strength with suitable mechanical properties. Use of the latter as vacuum cartridge coating has however been limited due to their forming conditions. Insert moulding by such a material, performed under high pressure, is liable to damage the coated components, in particular the fragile elements such as vacuum switches or fuses which comprise welds. For example, direct insert moulding of a vacuum cartridge with an elastomer of EPDM or silicone type deforms or destroys some constituent parts of the latter. As described in the document U.S. Pat. No. 5,864,942, a thermosetting elastomer is therefore only used, for a device having a vacuum chamber delineated by several components, as complement to a first coating, with a rigid protective layer being deposited around the cartridge before insert moulding.

SUMMARY OF THE INVENTION

Among other advantages, the purpose of the invention is to palliate the shortcomings of insulations of existing switchgear devices in a controlled atmosphere and to enable elastomers to be used directly on multi-component sealed enclosures.

In particular, according to one feature, the invention relates to a method for insulating a switchgear device having a chamber that is insulated as far as fluid exchanges are concerned, and that is delineated by an enclosure comprising several components, i.e. a tightly sealed enclosure presenting fragile areas, and in particular comprising ceramic and metallic parts coupled by brazing, in particular on the edge of the wall of a cover comprising a base-plate extended by metallic side walls joined on the periphery to the side wall of a ceramic part. Insulation is achieved by an insert moulding step involving high-pressure injection of an elastomer that is vulcanized. Before the switchgear device is placed in the injection mould, the device is assembled with protective cover-plates that cover the fragile areas. In particular, for a device of vacuum cartridge type in which the tubular central part is closed off by conducting covers, the cover-plates are fitted onto the covers and extend beyond the junction area between insulator and conductor. The shape of the cover-plates is further optimized to act as mechanical strengtheners.

In a preferred embodiment, the surfaces of the enclosure of the switchgear device that will be in contact with the injected elastomer, i.e. the protective cover-plates and/or a large part of the central tube, are prepared, for example with an adhering agent, to enhance adhesion of the elastomer. The elastomer can in particular be EPDM or silicone, and the method preferably continues with a painting step or an insert moulding step of said elastomer charged with conducting particles in order to electrostatically shield the switchgear device.

According to another feature, the invention relates to a switchgear device produced using this method. More generally, a switchgear device according to the invention, which is preferably axisymmetric, comprises a tightly sealed chamber extending along a longitudinal axis. The chamber is delineated by an enclosure which comprises an insulating tubular part, preferably made from ceramic, that is open at its ends and that operates in conjunction with advantageously metallic monoblock conducting covers closing off the tubular part. In particular, securing between the different components of the enclosure defines a junction area, which is advantageously a braze between thickness of the tubular part and thickness of the wall of the covers which are in the form of cylinders closed off by an end-plate at one of their ends.

The sealed chamber comprises two contacts that are movable with respect to one another along its axis. Preferably one of the two contacts is stationary and the other is movable, both of them being coupled to one of the two covers. In a preferred embodiment, a low pressure prevails in the chamber and the switchgear device is a vacuum cartridge.

The switchgear device according to the invention further comprises two cover-plates covering each of the covers and protecting their junction area with the tubular part. In particular, the cover-plates are in the form of bowls with a bottom wall substantially perpendicular to the axis of the switchgear device, and a peripheral wall extending along this axis over a sufficient distance to cover the side wall of the cover and also an end part of the insulating tube. The thickness of the cover is determined by its role of mechanical strengthener, with elimination of the fragile points of square edge type. Means, for example a direct contact, are provided to prevent the creation of a potential difference between both. A conducting spacer can separate the bottom of the cover-plate from the bottom of the cover in the longitudinal direction for ease of connection of the switchgear device assembly means.

The cover-plates are sufficiently rigid to act as mechanical strengtheners, and they are advantageously designed to act as dielectric deflectors—in particular, they do not present any square edges on their external surface and they can present bulges at the level of the junction points between insulator and conductor. It is moreover preferred for a seal to be present between the insulating tubular part and cover-plate so as to protect the junction area between cover and tubular part by locating it in a clean space. The seal can be made from elastomer and is advantageously fitted in a suitable groove of the cover-plate. Thus, in addition to mechanical protection against a higher external pressure, the braze is protected against fluid infiltration.

The switchgear device according to the invention finally comprises an elastomer cladding, preferably made from EPDM, around the enclosure of the chamber and the protective cover-plates with which it is in direct contact. The interface is "adherized", that is to say it is tightly sealed, devoid of empty spaces. The elastomer is advantageously coated with a conducting electrostatic shielding layer, for example the same charged elastomer. This elastomer can be used for the joining seal.

BRIEF DESCRIPTION OF THE FIGURES

Other advantages and features will become more clearly apparent from the following description of particular embodiments of the invention given as non-restrictive examples only and represented in the accompanying drawings.

DETAILED DESCRIPTION OF A PREFERRED EMBODIMENT

Figure 1:
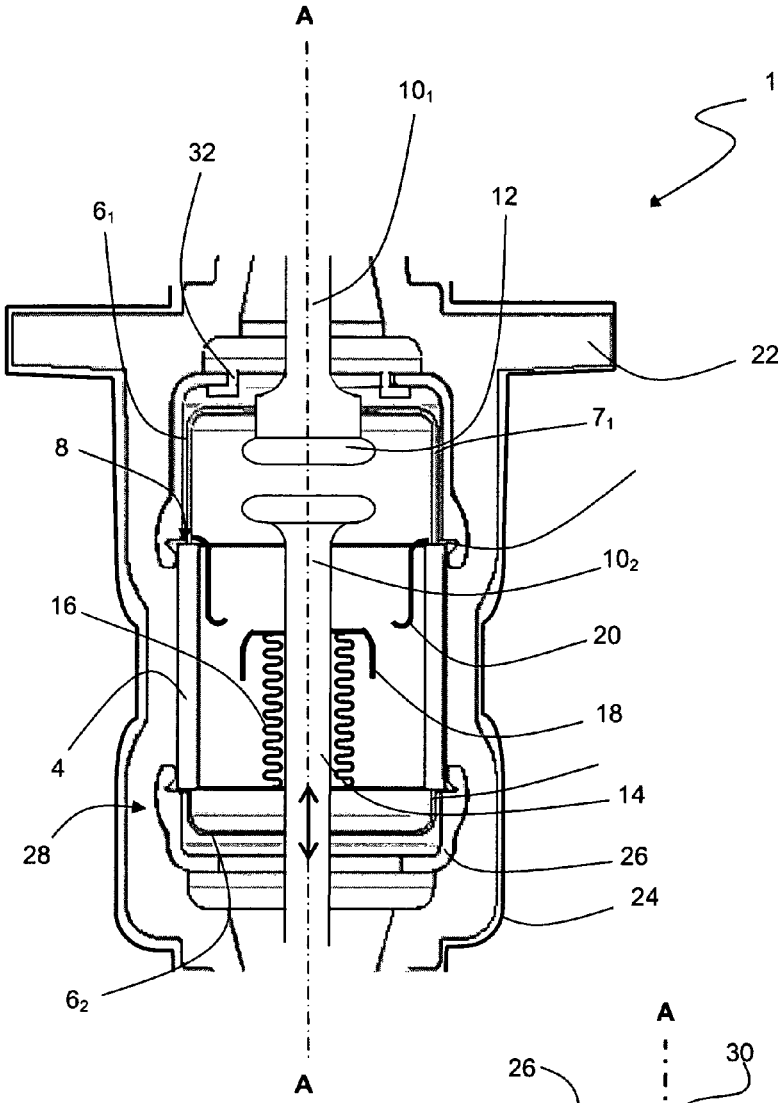
FIG. 1 represents a vacuum cartridge according to a preferred embodiment of the invention.

A vacuum cartridge 1 according to the invention, illustrated in FIG. 1, is designed for use in a switch to perform breaking in an electric circuit. The cartridge 1 according to the invention is preferably arranged to operate at high or medium voltage, i.e. between 1 and 75 kV or 52 kV, although use in low voltage is possible. Cartridge 1 comprises a sealed chamber, or envelope, 2 in which a controlled low pressure of air or another dielectric fluid preferably prevails, i.e. a vacuum. The chamber 2 is defined by a longitudinal enclosure extending along an axis AA, and that is advantageously axisymmetric (symmetric in revolution) for reasons of manufacturing and assembly.

The enclosure of chamber 2 comprises a first insulating central main part 4, advantageously made from ceramic although glass may be an option. The insulating part 4 is tubular, preferably cylindrical in revolution to optimize its mechanical and dielectric strength, and also to facilitate manufacture thereof. In the preferred embodiment, each open end of the tube 4 is delineated by an orthogonal section of its wall, thereby forming two superposable rings. The holes of the tube 4 are partly closed by conducting covers $\mathbf{6}_1$, $\mathbf{6}_2$. In the illustrated scope, the covers, or caps, 6 are made of metal and each comprise a substantially flat base-plate perpendicular to the axis AA, extended on its periphery by an orthogonal side wall 7 of the same shape as the tube 4 at the ends thereof. The side wall $\mathbf{7}_1$, $\mathbf{7}_2$ is more or less long depending on the use, but in all cases extends the end-plate to optimize the construction of the cartridge 1. To optimize their mechanical strength, the covers 6 are advantageously formed in a single part with a substantially constant thickness between the peripheral walls 7 and the base-plate.

The conducting covers 6 are secured in tightly sealed manner to the insulating tube 4 in a junction area 8. Although any known technique can be used, according to the preferred embodiment, the junction area 8 is limited to a line that corresponds to a braze of the peripheral wall 7 of the covers 6 on the insulating tubular wall 4. Advantageously, the homogeneous thickness of the tube 4 (for example about 6 mm for a cartridge 1 with an internal diameter of 65 mm operating at 17.5 kV) is greater than the thickness of the cover 6 (for example about 1.5 to 2 mm), and the two ends are placed edge to edge with a vacuum brazing of the cap 6 performed substantially in the centre of the wall of the tube 4.

The chamber 2 bounded by the ceramic tube 4 and covers 6 comprises a pair of arcing contacts $\mathbf{10}_1$, $\mathbf{10}_2$ that are movable with respect to one another along the axis AA of the cartridge 1. Each contact 10 comprises a contact pad 12 made from suitable material, such as CuCr, fixed onto a longitudinal copper electrode 14. Preferably, as illustrated, a first contact $\mathbf{10}_1$ is stationary, securedly fixed to one of the end covers $\mathbf{6}_1$ to which its electrode 14 is coupled to close the latter, for example by welding or mechanical assembly. The second contact $\mathbf{10}_2$ is mounted with axial sliding inside the cartridge 2 with its electrode 14 being able to move through the other bowl $\mathbf{6}_2$. To enable the movable contact $\mathbf{10}_2$ to move and to maintain the controlled atmosphere, a sealing bellows 16 is fitted between the movable electrode 14, to which it can for example be welded at one end, and the corresponding cover $\mathbf{6}_2$, thereby insulating the opening of the cover $\mathbf{6}_2$ of the chamber 2. A dielectric shield 18 can be fitted around the sealing bellows 16, at the level of the end thereof coupled to the electrode 14, to protect the latter against projections caused by a current interruption.

The tightly sealed chamber 2 preferably further comprises a dielectric shield 20 positioned at the level of the contact pads 12 whatever the position thereof in order to protect the ceramic 4 against any projections that might occur. Advantageously, the internal dielectric shield 20 is secured in fixed manner to one of the covers $\mathbf{6}_1$ to simplify the manufacturing process and to limit the number of brazes on the ceramic tube 4.

The cartridge 1 according to the invention is preferably used in limited spaces which may moreover be aggressive. For the switchgear means to be insensitive to the environment (pollution, dust, other soiling) and to reduce the dimensions, a solid insulation 22 is used to concentrate the dielectric stresses inside the insulator 22. A shielding 24 can be provided for the latter to confine them in the insulator eliminating any electric field of the ambient air. Furthermore, the cartridge 1 according to the invention is preferably suitable for storage conditions down to −40° C. and is designed to tolerate a large range of temperatures in operation, in particular an ambient temperature from −25° C. to 55° C., to which local heat rises due to operation (about 45° C.) should be added. A temperature range from −40° C. to +100° C. for the vacuum cartridge 1 preferably dilates the metal elements 6, 10, 16, 18, 20 of the chamber 2.

According to the invention, the dielectric insulating coating 22 of the vacuum cartridge 1 is chosen from elastomers that are sufficiently malleable to compensate the different expansions of the components of the enclosure of the cartridge 1 to which it is securedly affixed, for example with a Shore A hardness between 40 and 80. Silicones, in particular injectable silicone, rubbers or other thermosetting elastomers, can be envisaged. In the preferred embodiment of the invention, the dielectric coating is made from an ethylene-propylene-diene terpolymer or EPDM rubber (standing for Ethylene-Propylene-Diene Monomer) that is sufficiently malleable but that has a sufficient strength to protect the cartridge 1, for example a Shore A hardness of 70. The advantage of this material, apart from its cost, resides in its dielectric qualities known from other electrical applications.

Conventionally, for an elastomer such as EPDM that has properties suited to the application according to the invention, the material is injected at a temperature of about 60 to 80° C., i.e. in a viscous or even liquid state, into a mould heated to between 140 and 170° C. under a pressure of 100 to 150 bars. It is important to protect in particular the junction area between the components 4, 6 of the enclosure in order in particular to eliminate any failure of the braze 8. According to the invention, a suitable means is fitted, with a protective strengthener 26 on the enclosure at the level of the covers 6. The presence of such an additional element, the main purpose of which is mechanical, can moreover be taken advantage of to reduce the electric fields, and the mechanical strengthener 26 used in accordance with the invention is advantageously shaped to act as dielectric deflector.

A preferred embodiment of a strengthening cover-plate 26 comprises an end-plate extended at the periphery thereof by a side wall defining a recess in which the cover 6 of the cartridge 1 can be fitted. The side wall continues along the axis AA over a sufficient length to cover the junction area 8. To prevent field stress effects and mechanically fragile areas, although the internal recess may comprise square edges, the external surface of the cover-plate 26 is smooth with rounded blunt edges. The cover-plate 26 is advantageously axisymmetric and its external shape is determined according to the mechanical and dielectric stresses. In particular the end part of the side wall that is fitted at the level of the ceramic wall 4 and/or of the conducting braze 8, i.e. in an area where the field stresses are highest, comprises an annular bulge 28. For example, with a general thickness of about 4 mm, or at least sufficient for the mechanical stresses to which it is subjected, the dielectric cover-plate 26 can comprise a bulging end part 28 with a thickness of 8 mm, the length of which, about 16 mm along the axis AA, is arranged substantially on each side of the braze 8.

The cover-plate 26 can be made from conducting thermoplastic or thermosetting material. Advantageously, the cover-plate 26 is made as a monoblock part from a metal that has a proven strength, for example steel. Its general shape is preferably standardized, the size of the cylindrical part of its wall being adapted to fit that of the cover 6, as illustrated in FIG. 1. Furthermore the strengthener cover-plate 26 comprises a hole 30 for the electrode 14 to pass through and means 32 to which the contact 10, and more generally the cartridge 1, are coupled.

Figure 2:
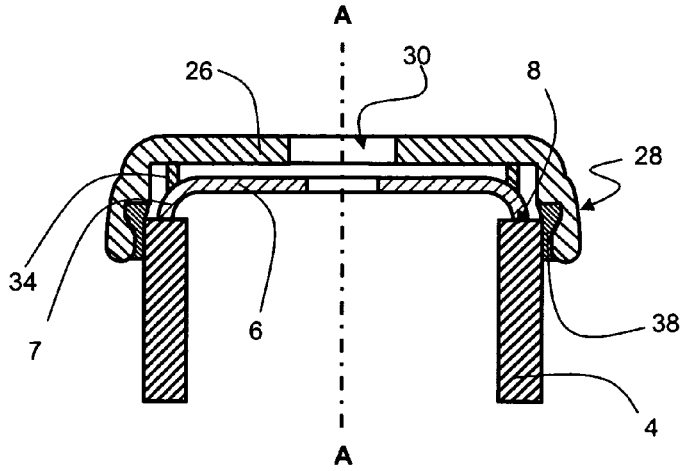
FIG. 2 illustrates mechanical protection before insert moulding according to a preferred embodiment of the invention.

In an embodiment illustrated in FIG. 2, a spacer 34 takes up the mechanical stresses between the cover 6 and the bottom of the cover-plate 26. The spacer 34 can be conducting and ensure the same potential between the cover 6 and cover-plate 26. It enables assembly with the coupling means 32 of the cartridge 1. Other geometric possibilities for the cover-plates 26 can be derived from the constraints by the person skilled in the trade. Whatever the solution, a contact is ensured between the live parts 6, 26 to prevent field lines from passing through the residual space.

Before insert moulding is performed, the vacuum cartridge 1 is therefore protected at the ends thereof by fitting of cover-plates 26 on its end covers 6, and has connection means 32 passing through it. The dielectric cover-plates 26 cover the junction areas 8 and a part of the ceramic tube 4 by means of their peripheral wall at the level of a bulge 28. Advantageously, the internal arrangement of the wall of the cover-plate 26 enables suitable positioning to be performed at the level of the junction braze 8, with a sufficient space to not stress this weak point when the cover-plate 26 is fitted.

Considering the injection pressure, it is preferable to position sealing means between the cover-plate 26 and ceramic tube 4 to eliminate infiltration of elastomer that is liable to stress the braze 8 and to thereby prevent deformation of the switchgear device 1. Any means can be envisaged, but for example the internal surface of the peripheral wall of the cover-plate 26 is provided with an annular groove 36 in which a seal 38 is fitted. The seal 38 is made from insulating or conducting material. It can be of any shape, for example toroidal, but its geometry is advantageously complementary to that of the groove 36 of the deflector 26 so as to distribute the stresses on the ceramic 4 when the insulating material is injected. The seal 38 can also enable the mechanical cover-plate 26 to be centred on the switchgear device 1.

The seal 38 is made from elastomer having a good compatibility with the insert moulding insulator 22, advantageously of the same nature as the insulating coating 22 (here EPDM) in order to preserve the same mechanical properties, and its hardness is compatible with the dimensional tolerances of the ceramic 4. Depending on the relative shapes of the groove 36 and of the seal 38, the latter can be inserted or made to adhere to the peripheral wall of the bulge 28.

Once the cartridge 1 has been assembled with the cover-plates 26 and seal 38, it is placed in a mould of suitable size and shape, preferably with centring means. The EPDM is injected in the residual space, the over-moulding thickness of which is determined by the lightning surge, and vulcanized. The cartridge 1 is then removed from the mould.

Preferably, the external surface forming the interface between the enclosure of the chamber 2 and cladding 22, in particular that of ceramic tube 4 and of dielectric cover-plate 26, is prepared so as to optimize bonding of the elastomer 22 and guarantee a tightly sealed direct adhesion without residual spaces liable to contain air. In particular, an adhesion agent can be used to optimize the interface and to counteract partial discharges.

Preferably, the dielectric over-moulding 22 is itself covered by a conducting or semi-conducting layer 24 called shielding layer, in particular an EPDM over-moulding charged to be conducting, which can be earthed. The field lines are thus kept inside the cladding 22 enabling other electrical equipment to be positioned near to the cartridge 1 according to the invention and ensuring that the latter is insensitive to the environment.

It should be noted that the mechanical protection role of the cover-plate 26 is essential with a large pressure difference between injection of the elastomer 22 and the inside of the chamber 2. However, even when this difference decreases or is even cancelled out, the dielectric action of the cover-plate 26 is maintained, and it can be recommended to keep the cover-plates 26 also for insert moulding at ambient pressure, for example with epoxy. In the latter case, to palliate differential thermal expansion problems, the dielectric cover-plate 26 advantageously keeps its mechanical role being made from malleable material, for example from charged EPDM to absorb the different strains between coating 22, cover 6 (and ceramic 4). Arrangements such as holes or clearances can be made therein if desired to act as compression spaces.

Although the invention has been described with reference to a vacuum cartridge, it is not limited thereto. Other elements may be concerned by the invention. In particular, insert moulding performed according to the invention can also be implemented on any device having an enclosure under a controlled atmosphere that presents a "fragile" junction between two materials. In particular, the invention finds an application for switchgear devices of fuse type with a sealed enclosure.

The invention claimed is:

1. Switchgear device comprising: a sealed chamber extending along a longitudinal axis wherein there are housed two contacts that are movable with respect to one another along the axis, wherein the enclosure of the chamber comprises a tubular part open at the ends thereof and two conducting covers securedly affixed to the tubular part by a junction area, each of the covers comprising an end-plate extended on its periphery by a side wall; two conducting cover-plates surrounding the covers, each of the cover-plates comprising a base wall and a peripheral side wall extending along the axis so that the junction area and an end of the tubular part are located in the cover-plate; and an elastomer insulating cladding of said enclosure of the chamber, wherein the interface between the cladding and tubular part, respectively cover-plates, is tightly sealed.

2. A switchgear device according to claim 1 wherein the external surface of the cover-plates is devoid of square edges.

3. A switchgear device according to claim 1 wherein the external surface of the cover-plates is designed for dielectric deflection.

4. A switchgear device according to claim 1 wherein the tubular part is insulating being made from ceramic, the cover is made from metal and brazed onto the end of the tubular part, the junction area defining a line on the wall of the tubular part.

5. A switchgear device according to claim 1 further comprising at least one seal between the tubular part and the peripheral wall of a cover-plate, so that the junction area is separated in tightly sealed manner from the cladding.

6. A switchgear device according to claim 5 wherein the seal is manufactured from an elastomer of the same nature as the cladding.

7. A switchgear device according to claim 1 further comprising a conducting coating around the insulating cladding to act as electrostatic shielding.

8. A switchgear device according to claim 1 wherein the insulating cladding is made from EPDM or from silicone.

9. A switchgear device according to claim 1 wherein the longitudinal axis of the device is an axis of symmetry.

10. A vacuum cartridge comprising a switchgear device according to claim 1 wherein the chamber is at a lower pressure than atmospheric pressure, one of the contacts is stationary and is securedly affixed to one of the covers and the other contact is movable through the other cover and its cover-plate.

11. Method for insulating a controlled-atmosphere switchgear device comprising a tightly sealed chamber delineated by an enclosure the tubular central part whereof is closed by two conducting end covers at the level of a junction area, each end cover comprising an end-plate extended on its periphery by a side wall comprising the junction area, said method comprising:

protection of the covers by cover-plates that extend to also cover the junction areas;

positioning of the switchgear device securedly attached to the cover-plates in a mould;

injecting an elastomer into the mould and vulcanization thereof.

12. A method according to claim 11 further comprising a preparation step of the external surfaces of the tubular part and/or of the cover-plates to facilitate adhesion of the elastomer.

13. A method according to claim 11 further comprising a coating step of the vulcanized elastomer with a conducting layer.

14. Vacuum cartridge comprising a tubular part open at the ends thereof and two conducting covers made of an end-plate extended on its periphery by a side wall which are securedly affixed to said tubular part by a junction area so as to form a sealed chamber extending along a longitudinal axis; wherein two conducting cover-plates surround the covers of the sealed chamber, each of the cover-plates comprising a base wall and a peripheral side wall extending along the axis so that the junction area and an end of the tubular part are located in the cover-plate; wherein the sealed chamber is at a lower pressure than atmospheric pressure and comprises a pair of a stationary contact securedly affixed to one of the covers and a movable contact which moves through the other cover and its cover-plate so as to form a switchgear device; said cartridge further comprising an elastomer insulating cladding of said switchgear device, wherein the interface between the cladding and tubular part, respectively cover-plates, is tightly sealed.

15. A vacuum cartridge according to claim 14 wherein the tubular part is insulating being made from ceramic, the cover is made from metal and brazed onto the end of the tubular part, the junction area defining a line on the wall of the tubular part.

16. A vacuum cartridge according to claim 15 further comprising at least one seal between the tubular part and the peripheral wall of a cover-plate, so that the junction area is separated in tightly sealed manner from the cladding.

17. A vacuum cartridge according to claim 16 further comprising a conducting coating around the insulating cladding to act as electrostatic shielding.

18. A vacuum cartridge according to claim 14 wherein the insulating cladding is made from EPDM or from silicone and is electrostatically shielded by a conducting coating made from the same material as the insulating cladding charged with conductive particles.

19. A vacuum cartridge according to claim 18 wherein the tubular part is made from ceramic, the covers are made from metal and brazed onto the end of the tubular part, the cover-plate are designed for dielectric deflection, and a seal made of an elastomer of the same nature as the cladding is located between the tubular part and the peripheral wall of the cover-plate.

* * * * *